United States Patent [19]

Lo

[11] 4,319,729

[45] Mar. 16, 1982

[54] TRIPOD ASSEMBLY

[76] Inventor: Jau-Lin Lo, 6 Lane 10, Szu Chuan Rd., Section 1, Pan Chiao City, Taipai Hsien, Taiwan

[21] Appl. No.: 165,417

[22] Filed: Jul. 3, 1980

[51] Int. Cl.[3] ..... A47B 91/00

[52] U.S. Cl. ..... 248/188.7; 211/203; 248/167

[58] Field of Search ..... 248/168, 169, 167, 434, 248/435, 164, 170, 171, 188.7; 211/203, 205

[56] References Cited

U.S. PATENT DOCUMENTS

| | | | |
|---|---|---|---|
| 295,636 | 3/1884 | Hayes | 248/165 X |
| 552,502 | 1/1896 | Andrews | 248/188.7 |
| 782,932 | 2/1905 | Uhl | 248/188.7 X |
| 1,335,726 | 4/1920 | DeLong | 248/165 |
| 1,764,226 | 6/1930 | Rennack | 248/165 X |
| 1,885,635 | 11/1932 | Schweitzer | 248/167 UX |
| 2,544,615 | 3/1951 | Raymond | 248/167 X |

FOREIGN PATENT DOCUMENTS

| | | | |
|---|---|---|---|
| 485490 | 5/1938 | United Kingdom | 248/188.7 |
| 1303099 | 1/1973 | United Kingdom | 248/188.7 |

*Primary Examiner*—J. Franklin Foss

*Attorney, Agent, or Firm*—LeBlanc, Nolan, Shur & Nies

[57] ABSTRACT

A novel construction of a simple tripod assembly, suitable for tables, chairs, cap and apparel stands, and tabletops, which have three or more supporting legs or other supports, and a central main shaft or main rod, and are readily disassembled, fixed and folded together to save space during packaging.

5 Claims, 6 Drawing Figures

TRIPOD ASSEMBLY

BACKGROUND OF THE INVENTION

The present invention relates to a simple foldable and disassemblable tripod assembly, and more particularly to a practicable construction of a simple tripod assembly, suitable for tables, chairs, cap and apparel stands, and tabletops, having three or more tubular supports and a central shaft or rod, and easily disassemblable, fixable and foldable to a single piece.

The lower end of a central main shaft of a conventional seat pad is constructed in a multi-tubular joint to fasten the connection of legs by means of generally three to five tubular legs, which, after insertion into the multi-tubular joint, are welded solidly as a whole, or screwed one by one with screws solidly onto the joint, or which are one by one screwed to the joint by way of threads. In such a construction and connection method, not only the assembly takes a lot of time, but, once it is assembled, it will be immpossible to simply fold up the legs to save packing volume and to facilitate transportation, unless all the legs are disassembled and piled up in pieces (welded legs cannot be disassembled).

Furthermore, to disassemble the legs requires screwing the screws tight or unscrewing the screws one by one. It is a very troublesome operation, and in addition, its construction is complicated with a much higher manufacturing cost.

SUMMARY OF THE INVENTION

The primary objective of the present invention is to eliminate the disadvantages of conventional tripods mentioned above and to provide a practical tripod assembly, having securely mounted legs, the legs being easily disassembled and folded up to thereby save space during packaging, shipping or storage.

The tripod assembly according to the present invention consists primarily a polygonal slip joint, a screw tube, a nut, and a plurality of supporting legs. The main characteristics are utilization of the slip fitting of tapered surfaces of the inner wall of the slip joint with the outer tapered surfaces of the nut and the assembly of the nut with the screw tube makes it possible to accomplish a tight fixing of the legs. In addition, the tripod is easily disassembled and folded.

These and other objects of the present invention will become more apparent from the ensuing disclosure and appended claims.

BRIEF DESCRIPTION OF THE DRAWINGS

For the convenience of description an embodiment of the present invention with round tubular legs and four supporting legs only is described hereby in line with the appended drawings.

DETAILED DESCRIPTION OF THE INVENTION

Figure 1:
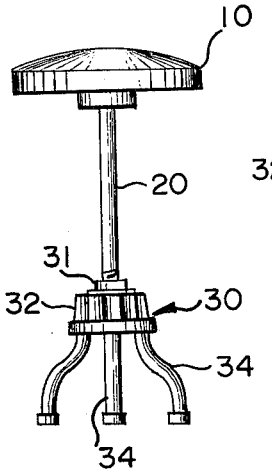
FIG. 1 is an elevation view of the present invention applied to a chair.

In FIG. 1, 10 is the seat pad of the chair, 20 is the shaft-rod supporting the seat pad, 30 is the tripod assembly according to the present invention, and 34—34 are the chair legs.

Figure 2:
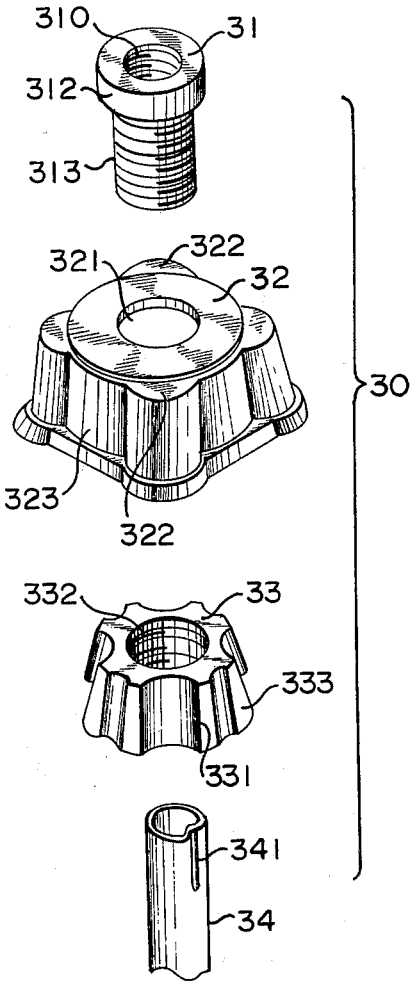
FIG. 2 is an exploded perspective view of the present invention.

The tripod assembly 30 mentioned above as shown in FIGS. 2 and 4, is composed of a screw tube 31, a joint 32, a nut 33 and legs 34—34.

Said screw tube 31 has female threads 310 throughout the inner wall thereof, its upper end forming a larger diameter portion 312, under which are formed male threads 313 all way down to the lower end. Said joint 32 is a rough flower-shaped metal housing with a hollow lower part having an open bottom end, in whose center there is an opening 321 into which said screw tube 31 can be inserted freely, and the hollow housing has four outward projections 322—322 equilaterally disposed at its periphery respectively, the inner wall thereof having tapered or inclined surfaces. In addition, said nut 33 is a rough flower-shaped body with a central threaded hole 332, made of metal, fiber reinforced plastic, rigid plastics or rubber.

Figure 4:
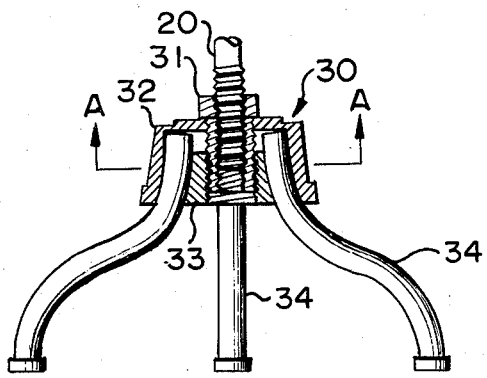
FIG. 4 is a section view of the joint with the nut and legs therein.
Figure 5:
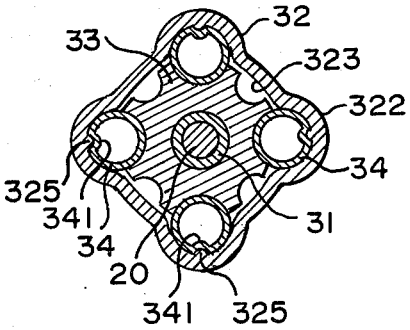
FIG. 5 is a bottom sectional view taken on lines A—A of FIG. 4.
Figure 3:
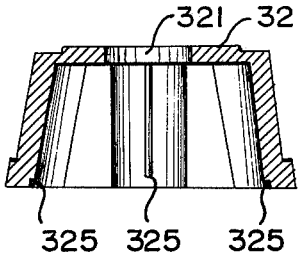
FIG. 3 is a sectional view of the joint in accordance with the present invention.

The outer wall of nut 33 has several inward recesses 331—331, capable of matching the inner walls of the outward projections 322 of said joint 32, and the outer walls thereof are inclined to mate with said tapered inner wall surfaces of said joint 32; thus, the nut 33 can be inserted in the hollow housing of joint 32, making the circular hole 332 matched with the joint opening 321, and in the meanwhile, a roughly circular hole is formed between said outward projections 322 and the inward recess 331 to receive the inserted end of supporting leg 34 as shown in FIGS. 4 and 5. In other words, the roughly circular or rather, cylindrical hole formed between each nut recess 331 and the inner tapered surface of a joint projection 322 provides a substantial area of contact surface for the inserted leg, which is virtually face to face, to thus assure that the leg members will be tightly gripped as nut 33 and joint 32 are brought together in assembly, with legs 34 in place. Furthermore, in order to prevent the rotation of legs after insertion on the inner wall surface of the outward projection of the joint according to the present invention is established a rib (or groove) 325. Each leg end has a groove (or rib) 341 as shown in FIGS. 4 and 5, and when the leg 34 is forced by the nut 33 to enter into the inner wall of joint 32, it is non-rotatably secured therein by pressing the rib 325 against the groove 341.

Figure 6:
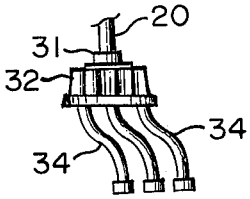
FIG. 6 is a front view of the present invention after the legs are folded.

Assembly of the present invention is as follows. FIrst the nut 33 is inserted into the hollow housing of the joint 32. Then, ends of the leg 34 are inserted one at a time into the circular holes formed by the projections 322 of joint 32 with the recesses 331 of nut 33. Threaded end 313 of the screw tube 31 is inserted through the opening 321 and screwed into the central threaded hole 332 of nut 33. Then, as screw tube 31 is tightened, the nut 33 cannot rotate in the joint 32, and therefore is moved upward along the screw tube 31, and because of the relationship of the tapered mating surfaces of the joint 32 and nut 33, the nut 33 presses tightly each leg 34 rigidly within joint 32. Thus, the four legs 34 may be secured solely by means of said nut 33 simultaneously, and assembled into a tripod assembly for use. Then the threaded end of screw tube 20 of seat pad 10 as shown in FIG. 1 is rotated into the screw tube 31 to form a high-quality rotary chair; if the main rod of a cap stand (not shown) is screwed into the screw tube 31 we obtain a convenient cap and apparel stand. In short, the present invention discloses a construction of a tripod assembly, whose scope of application can be changed as required, and furniture and fixture such as chairs, cap and apparel stands, table tops, and floor lamp-shade stands can utilize the tripod of the present invention. For convenience of transportation and storage the volume of the tripod assembly can be reduced, just by loosening the screw tube 31 so that the nut 33 can be lowered down. The legs 34 can then be folded as shown in FIG. 6. If the nut 33 is completely separated from screw tube 31, the legs 34, joint 32, screw tube 31 and nut 33 can be disassembled completely and packaged to save packing dimensions.

It should be pointed out the above embodiment according to the present invention serves only as an example and by no means restricts its construction. For example, the tripod is described as having four legs, and in fact, the present invention has two pairs of two legs each, out of which a tripod of legs of a a larger width can be constructed by means of some connecting rods. Other tripods with three, five, six, etc. legs can be made by minor modifications according to the present invention. As for the shape of the tripod legs, they can be oval, triangular, square, or polygonal.

Of course; the shape of the holes formed by matching the inward recesses of said nut and the outward projections of said hollow housing should be consistent with the shape of legs to be inserted therein. Besides, if the height of tripod is fixed, the inner hole of the screw tube can be made into a smooth opening, rendering the insertion of main rod even more convenient. In addition, the tapered surfaces in the above mentioned embodiment are provided at both the inner wall of said joint and the outer wall of said nut. However, only one of which formed with a tapered wall surface can also be applicable to the purpose of the present invention.

The present invention as constructed above, is not only very simple, but also results in a simplified operation of merely a screw tube and a nut to assemble, disassemble, and fold a multi-leg tripod. Certainly it is a kind of simple and practical invention.

I claim:

1. A tripod assembly comprising:

joint means in the general configuration of a bell housing, with an open bottom and means defining a central opening through the top thereof, the inner wall thereof being provided with a plurality of outwardly projecting, equispaced, upwardly tapering surfaces having a predetermined configuration;

nut means shaped to be accommodated within said joint means in nested, mating non-rotational relationship therewith, said nut means being provided with a plurality of equispaced, recessed surfaces thereabout, said recessed surfaces also having a predetermined configuration, said nut means having a central, threaded hole extending vertically therethrough;

screw means insertable through said joint means opening and having a threaded outer surface mating with the threaded hole in said nut means; and a plurality of curved, supporting legs each having an upper end having an external configuration mating with the internal configuration of the inner tapered surfaces of said joint means and the recessed surfaces of said nut means, said surfaces thus defining chambers having substantial surface areas, whereupon insertion of said leg upper ends into their respective said chambers and threading of said screw means through said joint means opening, into said nut means, said nut means is caused to withdraw into said joint means and tightly embed said leg means ends within their respective said chambers, due to the substantial surface area, face to face contact of said chambers with said leg upper ends to thereby form a rigid, unitary tripod structure.

2. A tripod assembly as claimed in claim 1, wherein a locking means is provided between said chambers and said inserted ends of said legs to prevent said leg members from rotating therein.

3. A tripod assembly as claimed in claim 1, wherein said screw means further comprises means defining a central bore extending vertically therethrough.

4. A tripod assembly as claimed in claim 3, wherein the central bore of said screw means is formed with female threads therein.

5. A tripod assembly as claimed in claim 1, wherein said leg members are formed of tubular material.

* * * * *